United States Patent [19]

Chapin et al.

[11] 3,999,534

[45] Dec. 28, 1976

[54] GAS OPERATED RIFLE

[75] Inventors: Joseph Chapin, Temple Terrace, Fla.; Edward Joslyn, Rochester, N.Y.; Joseph Ahrberg, Springfield, Mass.

[73] Assignee: Bangor Punta Operations, Inc., Greenwich, Conn.

[22] Filed: June 10, 1975

[21] Appl. No.: 585,725

Related U.S. Application Data

[63] Continuation of Ser. No. 519,483, Oct. 30, 1974, abandoned.

[52] U.S. Cl. ..... 124/74; 124/49; 124/53

[51] Int. Cl.[2] ..... F41B 11/06

[58] Field of Search ..... 124/11 R, 11 A, 13 A, 124/49, 52, 53, 57, 69, 70, 74, 72

[56] References Cited

UNITED STATES PATENTS

| | | | |
|---|---|---|---|
| 2,037,313 | 4/1936 | Duncanson | 124/52 X |
| 2,450,029 | 9/1948 | Wells | 124/13 A |
| 2,725,048 | 11/1955 | Koogle | 124/11 A |
| 3,142,294 | 7/1964 | Baldwin, Jr. | 124/52 X |
| 3,261,341 | 7/1966 | Merz | 124/11 R |
| 3,463,136 | 8/1969 | Vadas et al. | 124/11 R |
| 3,824,981 | 7/1974 | Crane et al. | 124/11 R |
| R27,568 | 1/1973 | Vadas et al. | 124/11 R |

*Primary Examiner*—Richard T. Stouffer
*Attorney, Agent, or Firm*—Patrick J. Walsh

[57] ABSTRACT

Disclosed is an air rifle having a frame carrying a barrel, a magazine, a mechanism for transferring BB shot from the magazine to a firing position relative to the barrel, a valve, a gas cartridge loading assembly, and a trigger for momentarily opening the valve enabling gas under pressure from the cartridge to fire the BB shot from the rifle. The magazine includes a tube carried along the underside of the barrel. A spring-biased rod is carried within the tube and urges BB shot along the tube toward the transfer mechanism. An aperture in the tube opens into a passage in the frame and which passage terminates along the underface of the forearm stock in a recess having tapered wall portions whereby, upon inversion of the rifle, BB shot supplied to the recess is directed through the passage into the tube. The forearm stock also has a recess along its underside for receiving the gas cartridge. A lever is pivotally carried by the frame and upon movement of the lever into the rifle cams a forwardly biased cartridge retaining element into engagement with the forward end of the cartridge. The cartridge is also displaced rearwardly in response to this lever action to engage the rear end of the cartridge about a piercing member whereby the cartridge is punctured and gas is delivered to the valve. Pivotal movement of the lever from the underside of the forearm stock, retracts the element against its spring bias enabling the cartridge to be removed from the recess and without the cartridge being propelled forwardly from the rifle by the issuance of residual gas through the punctured rear end thereof.

2 Claims, 7 Drawing Figures

GAS OPERATED RIFLE

This is a continuation of application Ser. No. 519,483, filed Oct. 30, 1974, now abandoned.

The present invention relates to air rifles and more particularly relates to a loading mechanism whereby BB shot can be readily, easily and expeditiously supplied to the magazine of the rifle and also to a gas cartridge loading and extraction assembly which facilitates insertion and removal of the gas cartridge utilized to provide the propellant charge for the BB shot through the barrel.

In many air-powered rifles, the pellets or BB shot are poured into the rifle's magazine through a very small slot or opening which is closed after loading. It is, of course, highly undesirable to load the BB shot into the magazine individually since this is a time consuming and laborious task. However, the loading of many conventional air rifles through the small slots or openings provided for this purpose is not much better than loading the BB shot individually. For example, where a slot is provided, the individual utilizing the rifle will usually, with his fingers, form a wall or partial enclosure about the slot such that the shot can be collected and directed through the slot into the magazine. This is difficult since oftentimes the slot is located along a curved surface of the rifle. This difficulty is compounded since an individual must hold the rifle while one hand pours the BB shot and the other hand directs the BB shot through the slot into the magazine. Not uncommonly, BB shot is spilled and lost when the rifle is loaded.

Many conventional air rifles utilize a gas cartridge to provide the propellant charge for the BB shot. In certain rifles, the cartridge is inserted into a bore and a cover is threaded into the bore to displace the cartridge within the bore against a piercing member or point at the opposite end of the bore. Should an unspent cartridge be removed by unthreading the cover, there is the danger that the cartridge will propel itself from the rifle with possible consequent injury to the individual using the rifle. While certain cartridge loading and extraction mechanisms prevent propulsion of the cartridge from the rifle upon attempted removal thereof, such apparatus requires an unacceptable amount of manipulation of the various parts of the rifle to load and extract the cartridge.

The present invention provides an air rifle which minimizes or eliminates the foregoing and other problems associated with prior air rifles and provides a novel and improved air rifle having various advantages in construction, operation and use in comparison with such prior air rifles. Particularly, the present air rifle is provided with a novel and improved loader and extractor mechanism for the gas cartridge. Specifically, the air rifle hereof is comprised of a frame carrying a barrel, a magazine for receiving the BB shot, a mechanism for transferring the BB shot in sequence from the magazine to a firing position relative to the barrel, a normally closed valve, a piercing element for puncturing the end of a gas cartridge, passages for supplying gas under pressure from the cartridge to the valve mehanism and a trigger mechanism for actuating the shot transfer mechanism and momentarily opening the normally closed valve whereby the gas charge fires the BB shot from the barrel. The magazine of the present air rifle includes an elongated tube secured along the underside of the barrel. A rod is carried within the tube and is spring-biased rearwardly. The tube is also provided with a loading aperture intermediate its length. An elongated slot is provided along the underside of the tube and a pin carried by the rod rides in the slot whereby the pin can be grasped and the rod moved forwardly along the tube such that the rear end of the rod uncovers the loading aperture. A shoulder is carried by the tube adjacent the forward end of the slot to provide an abutment for the pin whereby the rod can be maintained in this forwardmost position. The loading aperture communicates with a passage through the forearm stock. This passage terminates along the underside of the forearm stock in a recess characterized by tapered wall portions about the passage. To load the rifle, the rifle is first inverted such that BB shot or pellets can be poured directly into the recess, the tapered walls or the recess directing such shot into the passage and into the tube. After loading is complete, the pin carried by the rod is realigned with the slot and the spring displaces the rod rearwardly to bias the BB shot within the tube in a direction toward the transfer mechanism. Thus loading of the pellets or BB shot into the rifle can be effectively and expeditiously carried out with little chance of spilling BB shot and without the necessity and inconvenience of the user providing a wall about a loading slot to load the rifles's magazine as commonly done in loading conventional air rifles.

Another aspect of the present invention includes a novel and unique loader and extractor assembly for releasably retaining the gas cartridge within the forearm stock of the rifle and puncturing the end of the gas cartridge to supply gas under pressure to the valve. Particularly, this assembly includes a recess in the frame opening through the underside of the forearm stock. At the rear end of the recess, there is provided a piercing member having flow passages for communicating the gas from the cartridge to the valve. A slidable element having a head is provided along the frame adjacent the forward end of the recess. This element is preferably spring-biased forwardly to provide adequate room within the recess between the head and the piercing member for insertion of the gas cartridge. A lever is pivotally carried by the frame for movement between a position flush along the underside of the frame and a position depending from the frame. The lever and slidable element have cooperating cam surfaces whereby movement of the lever from its flush position to its depending position permits the spring to displace the head away from the piercing point and hence enlarge the recess for reception or extraction of the gas cartridge. When the lever is moved from its depending position to its flush position, the cam surfaces cooperate to displace the head rearwardly against the bias of the spring into engagement with the forward end of the gas cartridge. This rearward displacement continues whereby the gas cartridge is also displaced rearwardly such that the piercing element punctures the tip of the gas cartridge enabling gas to be supplied to the valve. The loading and extractor assembly also prevents an unspent cartridge from being propelled from the recess while simultaneously enabling extraction of the cartridge from the recess. When the lever is moved to its depending position, the head prevents forward expulsion of the cartridge from the recess yet permits withdrawal of the cartridge through the opening in the underface of the frame.

Accordingly, it is a primary object of the present invention to provide a novel and improved air rifle.

It is another object of the present invention to provide a novel and improved pellet or BB shot loading mechanism for an air rifle.

It is still another object of the present invention to provide a novel and improved BB shot or pellet loading mechanism for an air rifle wherein the pellet or BB shot may be directly poured into a recess in communication with the magazine of the air rifle.

It is still another object of the present invention to provide a novel and improved air rifle having the foregoing characteristics and including a tubular magazine underlying the barrel of the rifle and which magazine may be readily, expeditiously and efficiently loaded.

It is further object of the present invention to provide a novel and improved loader and extractor for the gas cartridges utilized in an air rifle.

It is a still further object of the present invention to provide a novel and improved loader and extractor for gas cartridges in an air rifle wherein a lever-type action is provided to initially pierce the gas cartridge and also to remove the spent or partially spent gas cartridges from the rifle.

It is a further object of the present invention to provide a novel and improved loader and extractor for the gas cartridges utilized in an air rifle and which loader and extractor is simple and inexpensive to manufacture, and readily and easily adjustable to obtain proper gas flow from the cartridge into the valve, and which also prevents propulsion of the gas cartridge from the rifle in the event a partially spent cartridge is removed.

These and further objects and advantages of the present invention will become more apparent upon reference to the following specification, appended claims and drawings wherein:

Figure 1:
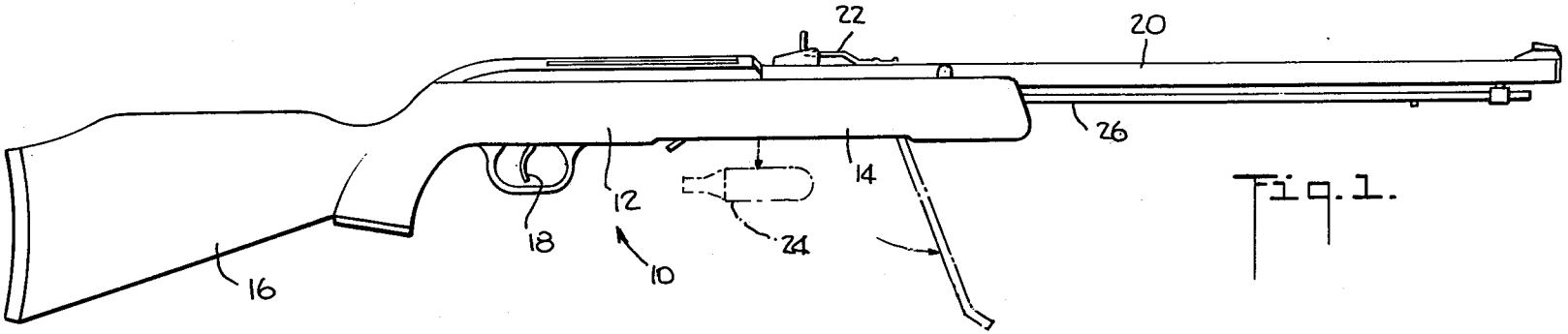
FIG. 1 is a side elevational view of an air rifle constructed in accordance with the present invention.
Figure 6:
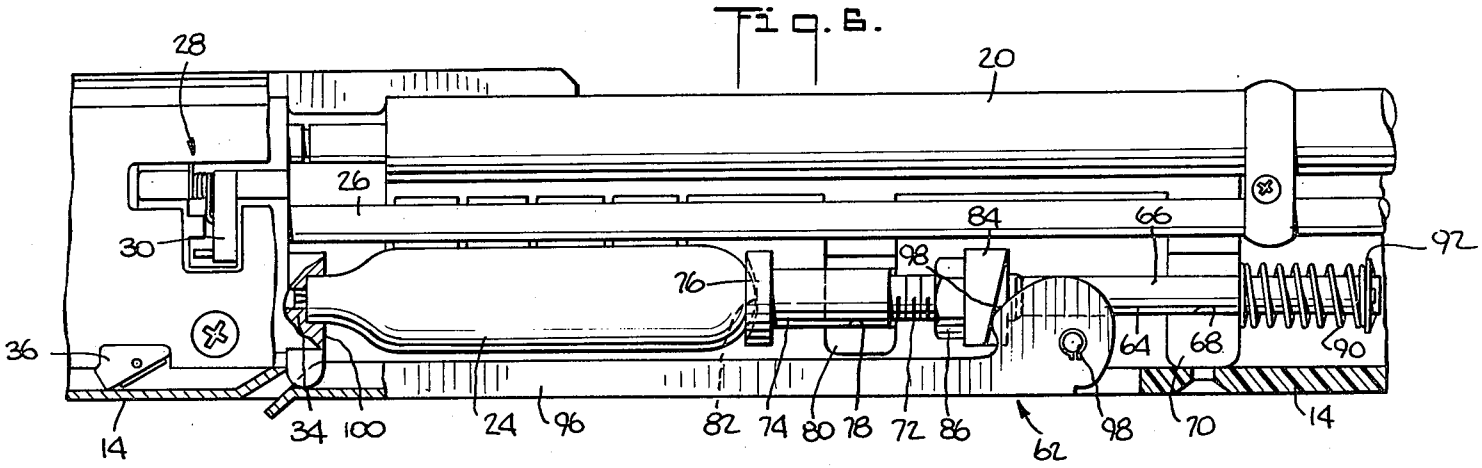
FIG. 6 is an enlarged fragmentary cross-sectional view illustrating the novel and unique gas cartridge loader and extractor for use with the air rifle hereof.
Figure 7:
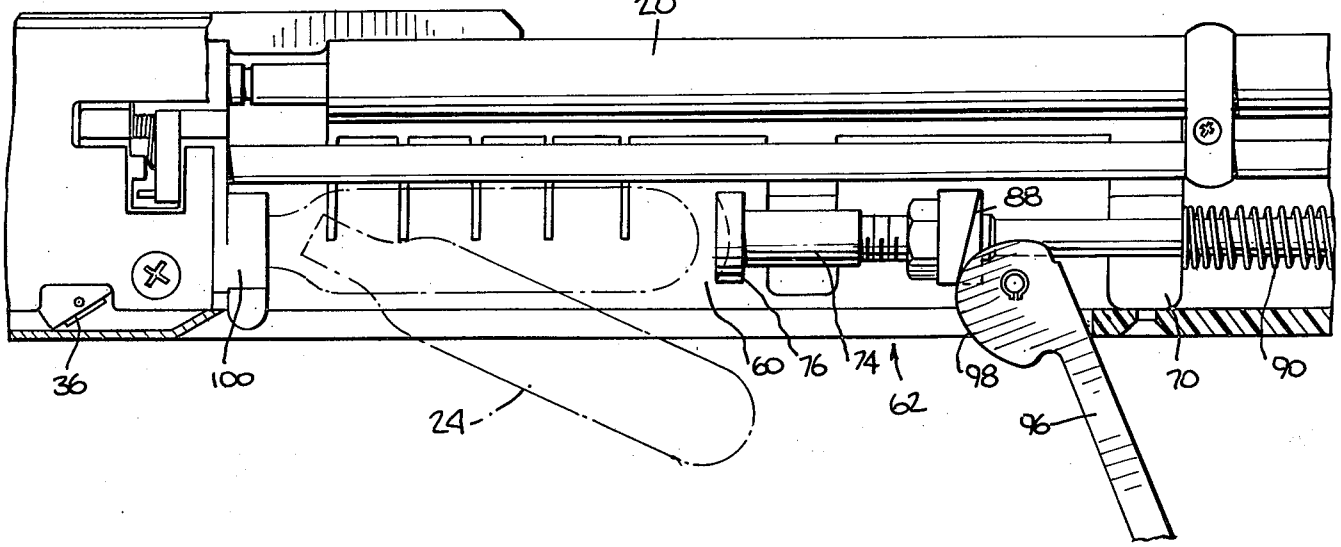
FIG. 7 is a view similar to FIG. 6 illustrating the mechanism in a loading or unloading position.

Referring now to the drawings particularly to FIG. 1, there is illustrated an air rifle generally designated 10 comprised of a frame 12 having a forearm stock 14, a shoulder stock 16, a trigger mechanism including a trigger 18 and a barrel 20. The barrel includes the usual sights 22. Rifle 10 is provided with a conventional gas cartridge 24, i.e., a $CO_2$ cartridge, for firing pellets or BB shot through barrel 20. Referring to FIGS. 6 and 7, rifle 10 is provided with a tubular magazine 26 and a transfer mechanism generally designated 28 for transferring the pellets or BB shot from tubular magazine 26 into a firing position in alignment with barrel 20. Particularly, a preferred transfer mechanism comprises an arm 30 having an aperture therein in registry with the end of magazine tube 26 for receiving the rearmost pellet or BB shot in tube 26. The arm 30 is spring-biased into such alignment and pivots, in response to actuation of trigger 18, into a position aligning the opening with the BB shot therein in a firing position in registry with barrel 20. A suitable magnet carried by the arm maintains the pellet or BB shot in the firing position and prevents it from rolling along the barrel.

Also referring to FIGS. 6 and 7, it will be seen that there is provided a piercing member 34 for piercing the end of gas cartridge 24 and supplying gas under pressure from the cartridge to a valve, the lower end of which is illustrated at 36. The valve is normally closed and momentarily, opens in response to pulling trigger 18 to supply gas under pressure through suitable passages, not shown, to the opening of the transfer assembly whereby the BB shot or pellet is fired from the rifle. The BB shot or pellet transfer mechanism 28 and valve 36 form no part of the present invention and it is therefore believed that the foregoing description is adequate to describe the nature and function of such parts and to demonstrate operation of the air rifle. The transfer and valve mechanism may, however, be of any suitable conventional type, for example, as shown in U.S. Pat. Nos. 3,119,384 or 3,261,134.

Figure 2:
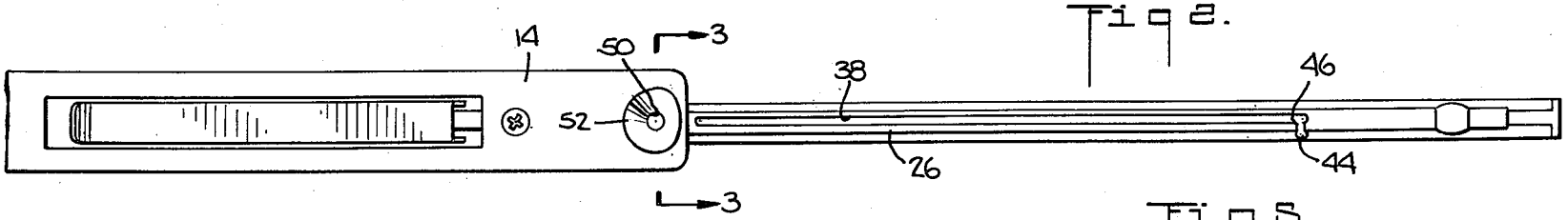
FIG. 2 is an enlarged fragmentary view thereof viewed from the underside of the rifle.
Figure 5:
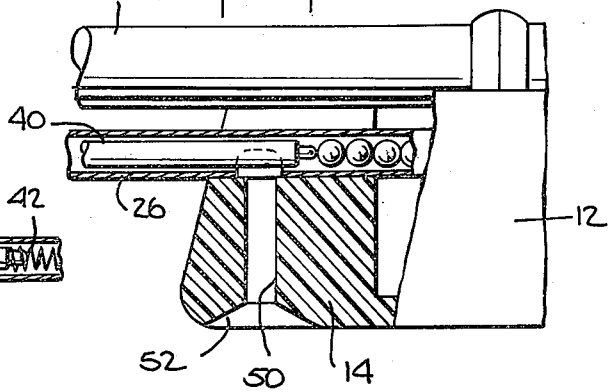
FIG. 5 is a view similar to FIG. 4 but with the rifle inverted and in firing position.

Referring back to FIGS. 1–5, magazine 26 comprises an elongated tube which extends at one end within the forearm stock 14 and terminates at its opposite end adjacent the end of barrel 20, tube 26 lying along the underside of barrel 20. As illustrated in FIG. 2, tube 26 is provided with an elongated slot 38 along its underside terminating at its forward end in an offset shoulder 46. A rod 40 is slidably carried within tube 26 and is biased by a helical spring 42 within the forward end of tube 26 for movement in a rearward direction and toward transfer assembly 30. The forward end of rod 40 carries a pin 44 which engages through slot 38 whereby the rod 40 an be displaced longitudinally within tube 26 by movement of pin 44 lengthwise along slot 38. When rod 40 is displaced to its forwardmost position along tube 26, the pin 44 may be rotated about the axis of rod 40 to butt shoulder 46 thus retaining the rod in its forwardmost position against the bias of spring 42. In this forwardmost position, the rear end of rod 40, as illustrated in FIG. 4, is located forwardly of a loading aperture 48 formed through the underside of tube 26.

The forward end of the forearm stock 14 is provided with a passage 50 lying in substantial vertical registry with aperture 48. Passage 50 terminates at its lower end in a recess 52 formed along the underside of forearm stock 14. Recess 52 is generally frustoconical in shape having tapered wall portions which extend about passage 50 and between the undersurface of forearm stock 14 and the entrance to passage 50.

Figure 4:
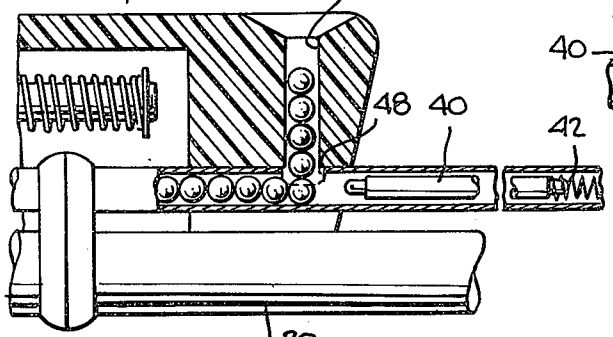
FIG. 4 is an enlarged fragmentary cross-sectional view illustrating the pellet or BB shot loading mechanism illustrated in FIG. 3.
Figure 3:
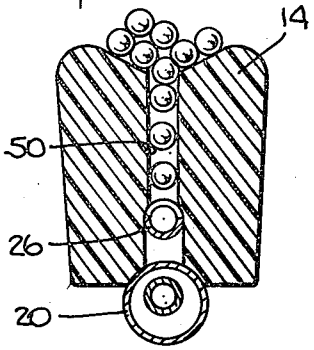
FIG. 3 is an enlarged cross-sectional view thereof taken generally about on line 3—3 in FIG. 2 and illustrating the novel and unique BB shot or pellet loading mechanism hereof.

When it is desired to load the air rifle with BB shot or pellets, rifle 10 is inverted to the position illustrated in FIGS. 3 and 4. Rod 40 is then displaced along tube 26 forwardly against the bias of spring 42 by moving pin 44 along slot 38. When pin 44 lies at the forwardmost portion of slot 46, it is pivoted laterally to butt shoulder 46. With rod 40 displaced forwardly, loading aperture 48 is uncovered and pellets or BB shot may be disposed through passage 50 into tube 26 between the rear end of rod 40 and transfer mechanism 28. With recess 52 forming an inverted frustoconical depression through the lower face of forearm stock 14 as illustrated in FIG. 4, a plurality of pellets or BB shot may be poured in recess 52 as illustrated in FIG. 3. The tapered walls of the recess direct the BB shot toward passage 50 whereupon they fall through passage 50 and loading aperture 48 into tube 26. When the magazine tube 26 is fully charged with BB shot, pin 44 is moved into alignment with slot 38 and released whereupon spring 42 displaces rod 40 rearwardly into engagement against the forwardmost pellet to urge the pellets within tube 26 toward the transfer mechanism. Concomittantly, the rod 40 covers loading aperture 48 whereby BB shot within tube 26 is prevented from falling through aperture 48 and passage 50 upon inversion of the gun into its firing position as illustrated in FIG. 1.

Referring now to FIGS. 6 and 7, the underside of forearm stock 14 isprovided with a bottom opening recess 60 for receiving gas cartridge 24. In order to retain cartridge 24 within recess 60 and to puncture the end of cartridge 24 to supply gas under pressure to valve 36, there is provided a loader-extractor mechanism generally designated 62. Mechanism 62 includes an element 64 comprised of a stepped shaft 66 slidable in an opening 68 formed in a cross brace 70 of frame 12. Element 64 has an intermediate threaded section 72 of larger diameter than shaft 66 and a still further enlarged diameter rear end portion 74 carrying a head 76. Shaft portion 74 is carried in an opening 78 formed in a cross brace 80 of frame 12. The rear face 82 of head 76 is concave or dished to conform, to a limited extent, with the bulbous forward end of gas cartridge 24 and to prevent the same from falling from recess 60 as will be clear from the ensuing description.

Carried along threaded portion 72 is a plate 84 threaded on section 72 and a lock nut 86 for securing plate 84 in selected axial position along section 72. The forward face of plate 84 is inclined or tapered at 88 along opposite sides thereof. A helical spring 90 encompasses shaft 66 with its rearward end butting cross brace 70. The forward end of spring 90 butts a washer 92 secured to the end of shaft 66. Spring 90 biases element 64 for movement in a forward direction.

It will be appreciated from a review of FIG. 7 that, when element 64 lies in its forwardmost position, ample room is provided between head 76 and piercing member 34 to insert a gas cartridge 24. When the gas cartridge 24 is inserted, a lever action is provided to displace head 76 against gas cartridge 24 and displace the latter rearwardly to enable piercing member 34 to puncture the cartridge whereby gas is provided from cartridge 24 to the valve. To this end there is provided a lever 96 pivotally carried on a pin 98 secured to frame 12. The forward end of lever 96 carries a pair of cam surfaces 98 which straddle shaft 66 and bear against the inclined or cam surfaces 88 of plate 84. These cam surfaces 88 and 98 cooperate such that, when lever 96 is moved from a position depending from frame 12 as illustrated in FIG. 7 to a position wherein lever 96 is closed into the rifle and lies flush with the undersurface of frame 12 as illustrated in FIG. 6, element 64 is displaced rearwardly against the bias of spring 90. Thus by closing lever 96 into the rifle, cartridge 24 is displaced rearwardly and punctured to supply gas to valve 36. It will be appreciated that in the operative position illustrated in FIG. 6, the concave face of head 76 prevents vertical displacement of the cartridge 24. Note also that plate 84 and nut 86 can be selectively located along the threaded portion 72 of element 64 whereby the proper setting for the puncture can be obtained.

Conversely, when lever 96 is moved from its flush position illustrated in FIG. 6 to its depending position illustrated in FIG. 7, spring 90 displaces element 64 forwardly to increase the distance between head 76 and piercing element 34. Extraction of gas cartridge 24 may then be accomplished simply by removing the cartridge from the recess.

It will thus be appreciated that this novel lever-type action is operable to releasably retain the gas cartridge 24 within recess 60. Particularly, by closing the lever into the rifle, the cartridge 24 is displaced rearwardly whereby piercing member 34 punctures the cartridge to provide gas under pressure to the valve. The puncture member 34 and the seal 100 about cartridge 24 at the rear end thereof as well as the concave face 82 of head 76 prevent displacement of the cartridge from the rifle during use. By simply pivoting lever 96 from the rifle, element 64 is displaced forwardly by spring 90 enabling extraction of cartridge 24 from recess 60. Note, however, that head 76 prevents expulsion of cartridge 24 from recess 60 under force of any residual gas remaining within cartridge 24.

The invention may be embodied in other specific forms without departing from the spirit or essential characteristics thereof. The present embodiment is therefore to be considered in all respects illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A gas operated rifle for firing a projectile comprising:

a frame having a recess a gas-containing cartridge received in said recess an elongated barrel, a magazine for containing a plurality of projectiles, means for transferring a projectile from said magazine into a firing position relative to said barrel, normally closed valve carried by said frame, means adjacent one end of said recess for piercing one end of the cartridge when in said recess for delivery of gas under pressure to said valve, means for opening said valve to propel the projectile through said barrel under pressure from the gas delivered through said valve from the cartridge, means carried by said frame adjacent opposite ends of said recess for releasably retaining the cartridge within said recess, said retaining means including an element carried by said frame adjacent the opposite end of said recess for movement in a direction generally parallel to said barrel and toward and away from said piercing means, means for moving said element toward and away from said piercing means to respectively displace the cartridge in said recess toward said piercing means and thereby puncture one end of the cartridge for delivering gas under pressure to said valve and enable displacement of the cartridge away from said piercing means, said moving means including a lever carried by said frame for pivotal movement about an axis generally normal to the long axis of said barrel from a first position lying substantially flush along the underside of said frame and a second position depending from said frame, said element and said lever having cooperating cam surfaces, means for biasing said element for movement in a direction away from said piercing means, said element being movable toward said piercing means in response to pivotal movement of said lever from said second position toward said first position and enabled for movement under the bias of said biasing means in response to pivotal movement of said lever from said first position toward said second position, said recess having an opening through the underside of said frame, said opening being of sufficient width and length such that said gas-containing cartridge may be inserted into said recess therethrough, and said lever being large enough in width and length for said lever to substantially cover said opeing to said recess in said underside when said lever is in said first position whereby said lever further acts as closure means for closing said opening to said recess when said lever lies in said first position thereof.

2. A gas operated rifle for firing a projectile comprising:

a frame having a recess for receiving a gas-containing cartridge, an elongated barrel, a magazine for containing a plurality of projectiles, means for transferring a projectile from said magazine into a firing position relative to said barrel, a normally closed valve carried by said frame, means adjacent one end of said recess for piercing one end of the cartridge when in said recess for delivery of gas under pressure to said valve, means for opening said valve to propel the projectile through said barrel under pressure from the gas delivered through said valve from the cartridge, means carried by said frame adjacent opposite ends of said recess for releasably retaining the cartridge within said recess, said retaining means including an element carried by said frame adjacent the opposite end of said recess for movement in a direction generally parallel to said barrel and toward and away from said piercing means, means for moving said element toward and away from said piercing means to respectively displace the cartridge in said recess toward said piercing means and thereby puncture one end of the cartridge for delivering gas under pressure to said valve and enable displacement of the cartridge away from said piercing means, said moving means including a lever carried by said frame for pivotal movement about an axis generally normal to the long axis of said barrel, said element and said lever having cooperating cam surfaces, said lever being pivotal from a first position extending along a side of said frame and a second position projecting outwardly from said frame, means for biasing said element for movement in a direction away from said piercing means, said element being movable toward said piercing means in response to pivotal movement of said lever from said second position toward said first position and enabled for movement away from said piercing means under the bias of said biasing means in response to pivotal movement of said lever from said first position toward said second position, and means for adjusting the location of the cam surface carried by said element along said element.

* * * * *